United States Patent [19]

Schreyer et al.

[11] 4,222,293

[45] Sep. 16, 1980

[54] BI-DIRECTIONAL WRENCH

[75] Inventors: Kenneth D. Schreyer, Clarence; Richard A. Borowiec, Grand Island, both of N.Y.

[73] Assignee: Columbus McKinnon Corporation, Tonawanda, N.Y.

[21] Appl. No.: 952,346

[22] Filed: Oct. 18, 1978

[51] Int. Cl.[3] ..... B25B 13/08

[52] U.S. Cl. ..... 81/90 B; 81/119; 81/186

[58] Field of Search ..... 81/90 R, 90 B, 119, 81/121 R, 121 B, 186

[56] References Cited

U.S. PATENT DOCUMENTS

| | | | |
|---|---|---|---|
| 58,313 | 9/1866 | Soumeillian | 81/90 B |
| 489,429 | 1/1893 | Brigger . | |
| 1,255,210 | 2/1918 | Newton . | |
| 1,303,157 | 5/1919 | Brockway . | |
| 1,367,297 | 2/1921 | Bullard | 81/121 B |
| 1,431,533 | 10/1922 | McLean . | |
| 1,481,401 | 1/1924 | Wentling . | |
| 1,504,847 | 8/1924 | Tarr . | |
| 2,386,342 | 10/1945 | Price . | |
| 2,671,363 | 3/1954 | Diebold . | |
| 2,673,632 | 3/1954 | Stiranka . | |
| 2,810,313 | 10/1957 | Hermanson . | |
| 3,003,379 | 10/1961 | Pribitzer . | |
| 3,338,359 | 8/1967 | Baillie et al. . | |
| 3,354,757 | 11/1967 | Grimm et al. | 81/90 B |
| 3,482,481 | 12/1969 | Newell et al. . | |
| 3,745,859 | 7/1973 | Evans et al. . | |
| 3,762,244 | 10/1973 | Evans . | |
| 3,850,057 | 11/1974 | Evans . | |
| 3,905,255 | 9/1975 | Evans . | |
| 4,080,851 | 3/1978 | Rogers . | |

*Primary Examiner*—James G. Smith

*Attorney, Agent, or Firm*—Bean, Kauffman & Bean

[57] ABSTRACT

A bi-directional wrench (2) capable of ratchet type action is disclosed for turning a member (6) with equally spaced peripheral recesses in either direction without reversing the position of the wrench. The wrench includes one or more teeth (14) and a pair of supports (19,20) on either side of and spaced from the teeth of the wrench for engaging the member. The supports (19,20) and the tooth or teeth (14) of the wrench are configured to permit radial disengagement of the teeth (14) from the recesses of the member (6). In a preferred form, complete removal of the wrench from the member is prevented by the shape of the wrench to enable a true ratchet type action.

3 Claims, 13 Drawing Figures

Fig. 3.
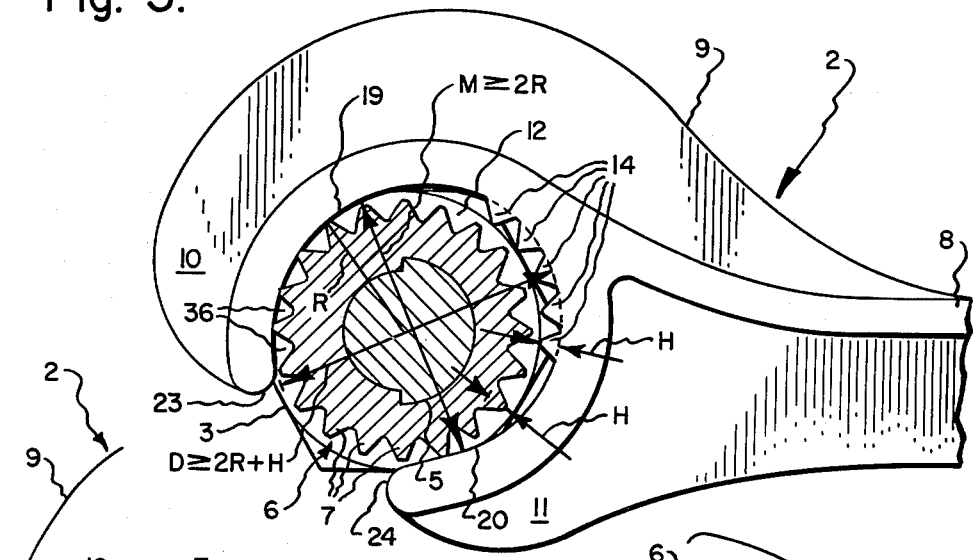
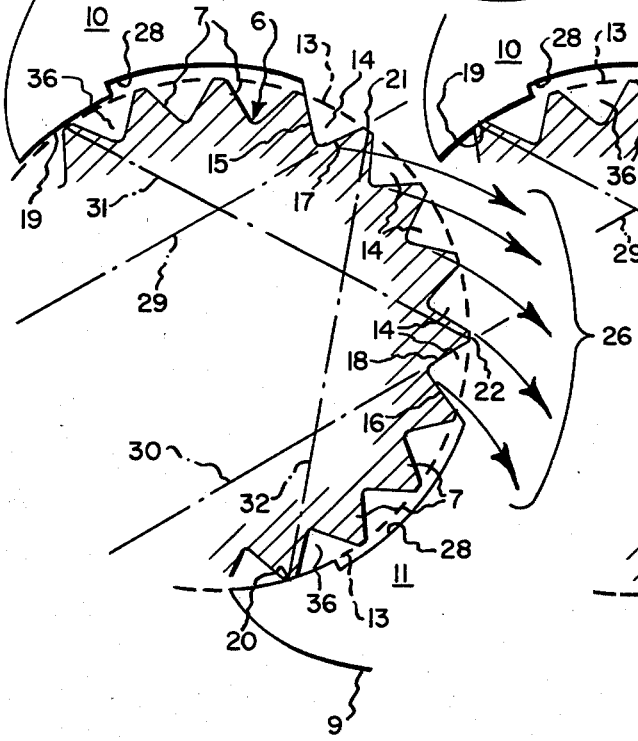
Fig. 4.
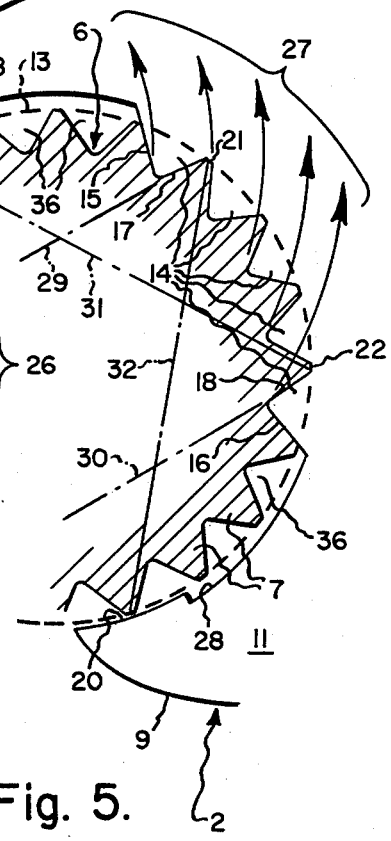
Fig. 5.

Fig. 6.
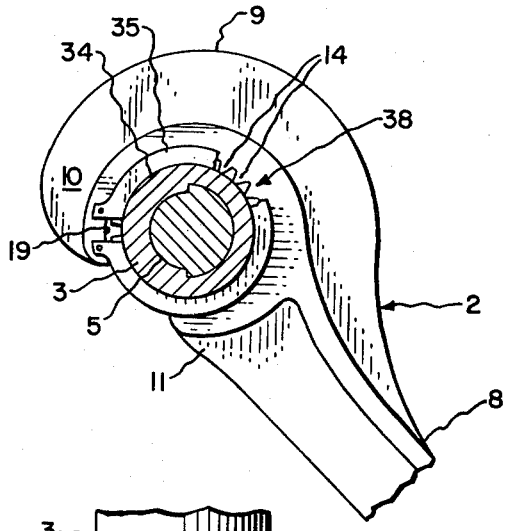
Fig. 7.
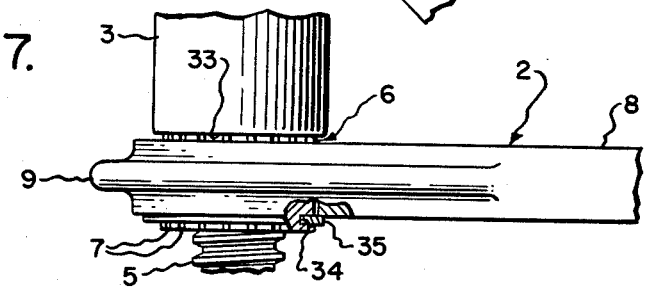
Fig. 11.
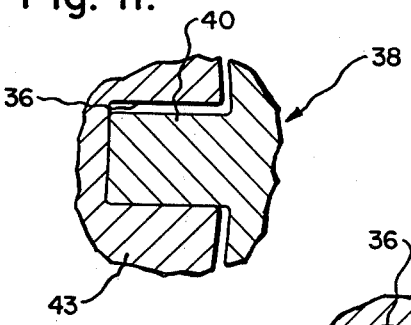
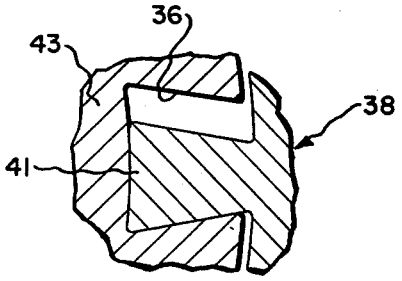
Fig. 12.
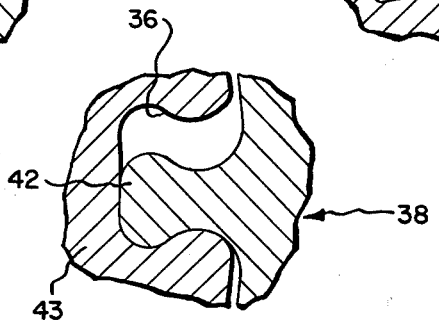
Fig. 13.

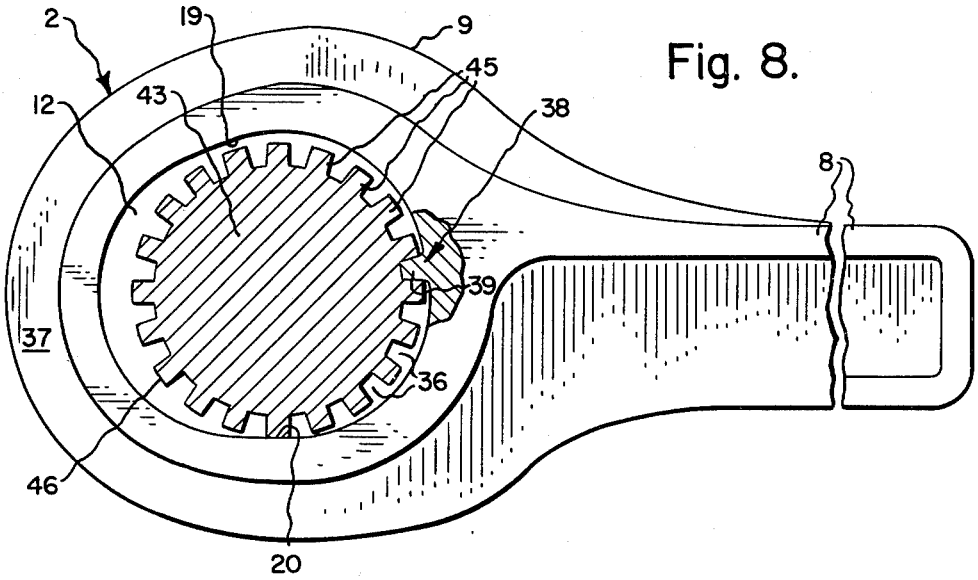
Fig. 8.
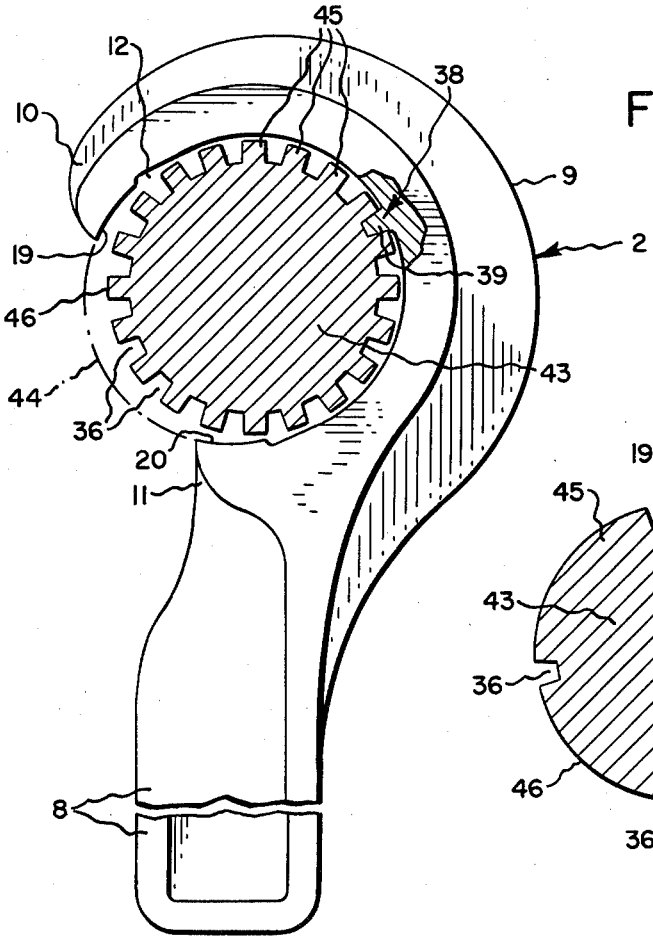
Fig. 9.
Fig. 10.
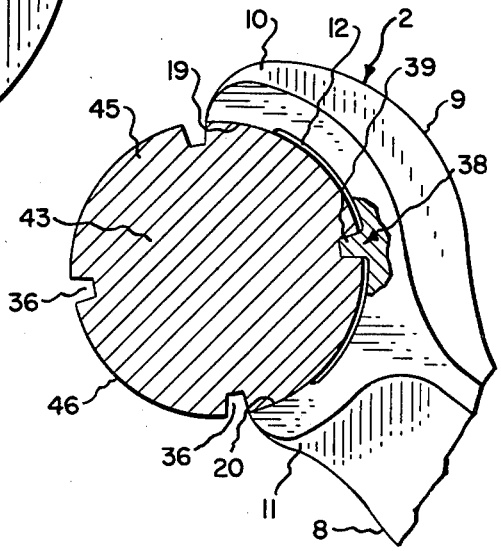

BI-DIRECTIONAL WRENCH

TECHNICAL FIELD OF THE INVENTION

The present invention generally relates to wrenches for turning a toothed member. More particularly, the present invention relates to a wrench for turning a telescopic load binder in a ratchet-type bi-directional manner, without the need for removing the wrench from the member and turning the wrench end for end or side for side to permit the wrench to drive in the opposite direction.

BACKGROUND OF THE INVENTION

In many applications it is necessary to turn a member having a shaped driving head many revolutions in a single direction followed by turning in the opposite direction. Prior wrenches have typically been of one of two general designs. The first type includes an integrally formed handle and working head which engages the shaped part of the member to be turned. While having the advantage of small cost, most integrally formed wrenches of this kind have the disadvantage of being capable of only turning the member a fraction of a turn before the wrench must be completely disengaged and reengaged at different angular orientation in preparation for the next fractional turn. This process is obviously time consuming, arduous and fatiguing so that efforts have been made to design "speed" wrenches which may be used to grip the member while turning in one direction and which may be moved in the opposite direction without the requirement of disengagement of the wrench from the member. These "speed" wrenches, exemplified by U.S. Pat. Nos. 3,905,255; 3,850,057; 3,762,244; and 3,745,859, however, have the disadvantage that in order to obtain a reversal of direction, the wrench must be disengaged from the member and reengaged after the wrench has been reversed end to end or turned over side to side. Space limitations sometimes render such wrench reversal both awkward and undesirable.

The second type of wrench commonly used for turning a member many revolutions is a ratchet type of wrench having moving parts for engaging one or more of a plurality of teeth of the member to be turned. Exemplary of this second type of wrench are the ratchets of U.S. Pat. Nos. 4,080,851; 3,338,359; 2,673,632; and 1,255,210. Ratchets of this type have the disadvantage, however, of being expensive to manufacture due to the moving parts which are prone to early wear related failure. Additionally, such ratchets are frequently locked onto the shaft to be turned so as to be incapable of removal, which fact occasionally causes difficulty not only due to the space required for the projecting wrench handle but also due to the fact that unauthorized persons, such as vandals, are consequently able to release the load.

It is therefore apparent that a need has previously been felt for a simple, inexpensive integrally formed bi-directional wrench which is removable from a member such as a turnbuckle load binder.

THE INVENTION

The design of a wrench which overcomes the deficiencies and disadvantages of the prior art devices has been discovered and is the subject of this patent. The bi-directional wrench of the present invention has been designed for turning a cylindrical member in either direction without end to end or side to side reversal of the wrench. The member, such as a nut, includes a multiplicity of equally spaced, outwardly projecting teeth around its periphery to form a cross-sectional profile that has the appearance of a multi-lobed star. The wrench itself is adapted to engage the teeth of the multi-lobed member and includes an integral handle and head with a pair of jaws configured to form a member receiving opening.

A member engaging means, such as a tooth or teeth, is provided to project inwardly into said opening and to engage the member in the recesses formed between the member's teeth so as to apply a generally tangentially directed force to the member at the point or points of engagement. Also provided are a pair of rigidly fixed fulcrum means, one on either side of the engaging means for bearing against the exterior of the member. The fulcrum means and the member engaging means are configured and positioned relative to one another to permit disengagement of the engaging means from the member by movement of the wrench outwardly along one of the radii of the member without angular rotation of the wrench.

In the preferred embodiment the head of the wrench encircles the member through an angle of more than 180 degrees while the end portions of the encircling head are spaced from one another by a distance less than the largest diametral dimension of the member. This arrangement captivates the member within the wrench member receiving opening so that the member cannot be completely separated from the wrench by purely radial movement of the wrench relative to the member.

In one embodiment the opening is bounded in part by a plurality of wrench teeth lying on a concave cylindrical surface having a radius of curvature substantially equal to but not less than the radius of the multi-lobed star drawn from the central axis of the member to the tip of one of its teeth or lobes. The wrench teeth are equally spaced and inwardly projecting and are preferably formed with planar sides adapted to engage the teeth of the multi-lobed member. An essential characteristic of the teeth of the wrench is that the two outermost teeth of the wrench are configured so that their mutually facing sides are gradually divergent in the direction of the concave opening. In this embodiment the supports or pads provided substantially lie on the circular extension of the cylindrical surface. Each of these pads provide support on fulcrum means for contact with the multi-lobed member whereby the point of contact therebetween tends to act as a fulcrum about which the wrench wants to turn. Each of these fulcrum points are positioned such that a line drawn from the inner root point of the opposite one of the two outermost teeth of the wrench form an angle of less than 90° with the facing side of the opposite one of said outermost teeth.

In a particularly preferred embodiment, the jaws of the wrench are configured to form an elongated opening which may be open or closed at one end. In this embodiment, the preferred position of the teeth of the wrench is at one end of the oval, said oval having a major diameter at least equal to twice the radius of the multi-lobed member plus the height of one of its teeth or the height of one of the teeth of the wrench, whichever is smaller. The minor diameter of the opening is at least equal to twice the radius of the multi-lobed member.

This configuration permits the teeth of the wrench to be disengaged from and reengaged with the lobes of the member in order to obtain a new "bite". Accordingly, the wrench may be used in a ratcheting manner without completely removing the wrench from the member. The ratcheting action is further facilitated by a design feature in which the tips of the jaw pairs have a separation distance smaller than twice the radius of the multi-lobed member to thereby captivate the member within the ovular opening of the wrench.

Also, in a preferred embodiment, both the concave cylindrical surface and the plurality of wrench teeth are disposed to point away from the handle of the wrench. Additionally, recesses may be formed in the jaws of the wrench intermediate the pads and the nearest one of the plurality of wrench teeth. The recesses effectively prevent contact between the jaw material and the adjacent teeth of the multi-lobed member thereby assuring that the wrench will only contact the lobes of the member at the fulcrum point on the support pad.

In any of the above described embodiments, the engaging means may include one or more teeth which may have a variety of shapes. Accordingly, depending upon one's particular preference, the teeth of the wrench may be configured to have a square profile, a bulbular profile with curvilinear surfaces, or a profile which tapers either radially inwardly or radially outwardly. In the case of a radially outwardly taper, a tooth having flat sides assumes a generally keystone shape in which the efficiency of engagement between the teeth of the wrench and the member is increased. In each of the above described cases, it is desirable for the recesses formed in the member to have profiles similar to the profiles of the teeth so that matching surfaces are provided.

Finally, the present invention has specific application to a load binder and a wrench for turning the load binder. In such an application, it may be desirable to lock the wrench onto the load binder so that it may not be completely removed. Accordingly, one of the embodiments of the invention includes a wrench which encircles the member (a toothed portion of the load binder body) by more than 180 degrees with the end portions of the wrench head being separated by a distance less than the outside diameter of the toothed portion of the load binder body. In this manner the wrench is prevented from being removed radially from the load binder. Additionally, a shoulder is provided on the load binder at one end of the toothed portion and a groove and snap ring are provided at the other end of the toothed portion: there two features preventing movement of the wrench axially of the load binder body so that its axial position is restricted to the toothed portion of the load binder.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which:

FIG. 3 is similar to the view of FIG. 2 with the exception that the wrench is shown disengaged from the load binder during the return throw of the ratchet wrench;

FIGS. 4 and 5 show an enlarged view of the engaging portion of a second embodiment of the bi-directional wrench of the present invention, FIG. 4 showing clockwise rotation and FIG. 5 showing counterclockwise rotation;

FIGS. 6 and 7 show an end view and a plan view respectively of a load binder/wrench combination in which the load binder and wrench are rendered inseparable by the configuration of the wrench head and by a shoulder and snap ring retainer on the load binder;

FIGS. 8, 9 and 10 show alternative embodiments of the wrench of the present invention and illustrate a variety of wrench head-handle configurations; and FIGS. 11, 12 and 13 illustrate possible alternative tooth shapes and member recess shapes.

DESCRIPTION OF THE BEST MODE OF THE INVENTION

Figure 1:
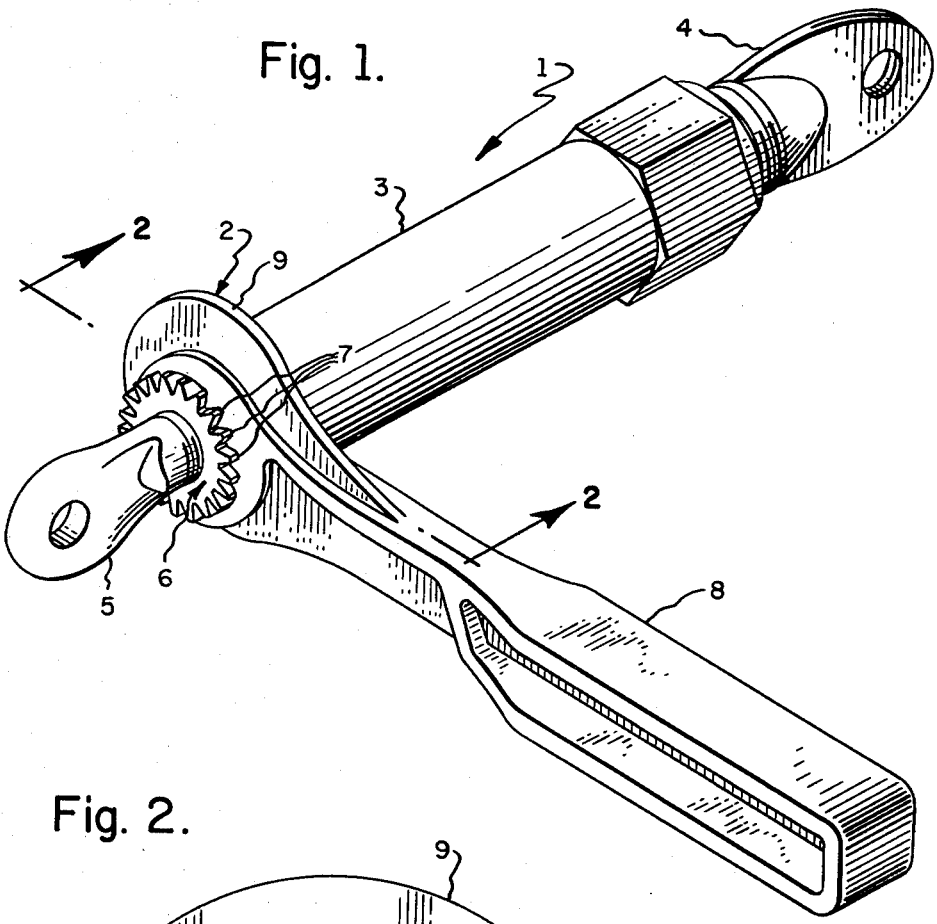
FIG. 1 generally illustrates the bi-directional wrench of the present invention as shown in use with a chain tensioning device or load binder.

While the present invention is susceptible of various modifications and alternative constructions, there is shown in the drawings and there will hereinafter be described, in detail, a description of the presently preferred or best mode of the invention. It is to be understood, however, that the specific description and drawings are not intended to limit the invention to the specific form disclosed. On the contrary, it is intended that the scope of this patent include all modifications and alternative constructions thereof falling within the spirit and scope of the invention as expressed in the appended claims, to the full range of their equivalents.

Turning now to an examination of the figures, the novel bi-directional wrench of the present invention will be described in general and in particular. FIG. 1 generally shows a wrench 2 having a handle 8 and a working head 9 in working engagement with a telescopic load binder 1. The telescopic load binder 1 generally consists of a barrel 3 with opposite ends threadedly engaging oppositely threaded members 4 and 5. As is well known, rotation of barrel 3 in one direction causes members 4 and 5 to be drawn together while rotation in the opposite direction causes members 4 and 5 to be forced apart. Means are provided on barrel 3 for its engagement by a wrench including a hexagonally shaped nut portion at one end for engagement by a standard open-end wrench, and a cylindrical portion 6 at its opposite end having a multiplicity of equally spaced outwardly projecting teeth 7 around its periphery whereby the cross-sectional profile of the cylindrical portion 6 at the location of the teeth has the appearance of a multi-lobed star. As can be seen from FIG. 1, the wrench 2 is adapted to engage with the teeth 7 of the multi-lobed member 6 for working the load binder 1. It will be recognized that while the wrench of the present invention is shown in practical application as applied to a load binder, the scope of the invention is not necessarily limited to the illustrated application so that the multi-lobed star-like cylindrical member 6 may be formed on any member, rotation of which is desired, such as a nut or the head of a bolt.

Figure 2:
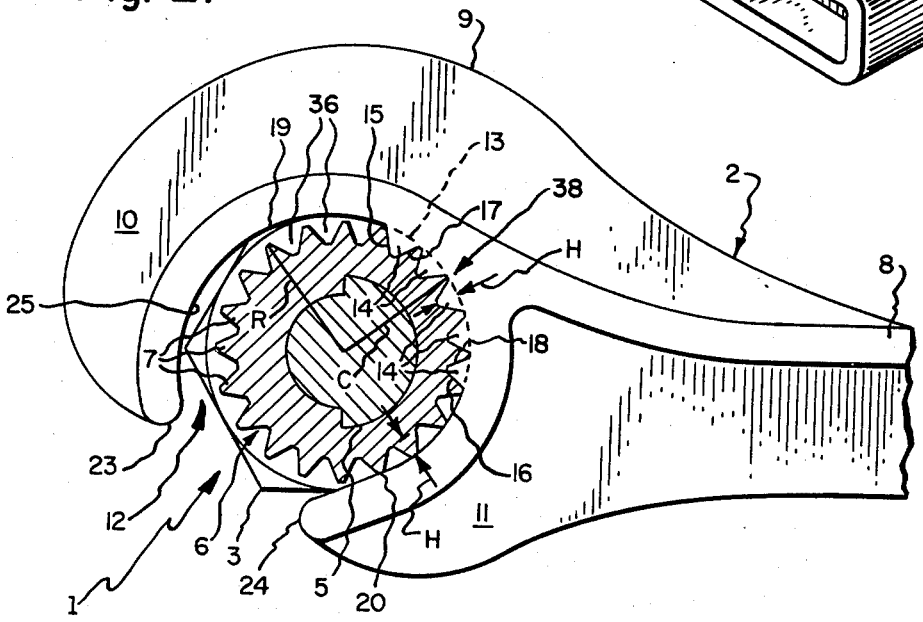
FIG. 2 is a cross-sectional end view of the wrench and load binder as shown in FIG. 1, said end view illustrating the ratchet in engagement with the multi-lobed portion of the load binder for clockwise rotation thereof.

Turning now to an examination of FIG. 2, it can readily be seen that the working head 9 of wrench 2 is integrally formed with the handle 8 and includes a pair of integrally formed jaws 10 and 11 which define an ovular concave opening 12. Ovular opening 12, at least in part, follows a concave cylindrical base line or surface 13 having a radius of curvature C substantially equal to but not less than the radius R drawn from the central axis of the cylindrical member 6 to the tip of one of the teeth 7. A plurality of wrench teeth 14 lie on and project inwardly from the concave cylindrical surface 13. Wrench teeth 14 are equally spaced with planar faces or sides adapted to engage the faces or sides of the teeth 7 of member 6.

The outermost two teeth of the set of teeth 14 of the wrench are indicated in the figures by the numerals 15 16. The inwardly or mutually facing sides of these two outermost teeth have been designated 17 and 18 respectively. It is a feature of the present invention that sides 17 and 18 are formed to gradually diverge from one another in the direction of the concave opening 12. This feature assures relative easy engagement of the wrench teeth with the teeth of the cylindrical member 6. In the same respect, the corresponding teeth 7 of cylindrical member 6 which face sides 17 and 18 preferably are formed to have their two adjacent sides formed so as to be slightly converging in the direction away from the axis of cylindrical member 6. It should be noted, that while the teeth 7 of cylindrical member 6 and teeth 14 of wrench 2 are shown to have a generally triangular cross-sectional profile, it should be understood that these teeth might very well have another, albeit, equally suitable shape.

FIG. 2 shows wrench 2 in engagement with cylindrical member 6 in a manner appropriate for clockwise rotation. When so operated, a portion 20 of lower jaw 11 bears against one of the teeth 7 of cylindrical member 6 to act as a fulcrum or a pivot point around which the wrench tends to rotate. True rotation around point 20 is prevented, however, by the interfering engagement of the teeth 14 furthermost from support point 20 (starting with tooth 15) so that the action produced is a rotation around the axis of cylindrical member 6 rather than about support means 20. In order for the wrench to be operative, it is necessary that the angle formed by the inner face 17 of tooth 15 and the line 32 drawn from support point 20 to the inner root point 21 of tooth 15 must be an acute angle or less than 90°. The inner root point of the outermost two teeth of the wrench is defined as that point at which the facing sides (17 or 18) of the opposite ones of the two outermost teeth (15 or 16) intersect with the cylindrical surface 13.

These relationships are best seen in FIG. 4 from which it can be seen that a family of arcs 26, drawn about support point 20, illustrate the paths that the tips of teeth 14 want to follow. Some of these arcs intersect a significant portion of one of the teeth 7 of cylindrical member 6 so that a clockwise force exerted on the handle of the wrench is transmitted to and causes the cylindrical member to rotate around its cylindrical axis. Also depicted in FIG. 4 is the location of a second support point 19 and the corresponding relationships between it and the surface of the side 18 of tooth 16. This second support point 19 functions when the handle is moved in counterclockwise direction. The angle formed between the line defining the side 18 of tooth 16 and the line 31 drawn from the support point 19 to the inner root point 22 of tooth 16 defines an angle less than 90°.

The set of arrows 27 in FIG. 5 illustrates the paths which the tips of the teeth 14 of wrench 2 would travel if it were not for the teeth 7 of the cylindrical member 6. As can be seen, at least three of the teeth 14 of wrench 2 would tend to follow paths which are obstructed by the corresponding teeth 7 of the cylindrical member 6.

Turning now to an examination of FIG. 3, it can easily be seen that jaws 10 and 11 extend out and around in a manner to captivate cylindrical member 6 within an ovular shaped opening 12. The ovular shaped opening has a major diameter D greater than or equal to twice the radius R of the cylindrical member 6 plus the smaller elevation H of the teeth 7 of the cylindrical member 6 or the teeth 14 of wrench 2. The minor diameter M of the ovular opening 12 formed by jaws 10 and 11 of wrench 2 is at least equal to twice the radius R of the cylindrical member 6. When these relationships are adhered to, the wrench may be pulled back and disengaged from the teeth of the cylindrical member so as to permit the wrench to be rotated to a new "bite" position without interference between the facing teeth 7 and 14. In this respect, it is desirable to have one of the jaws 10 and 11 form an idling cylindrical surface 25 whose radius of curvature is equal to the radius R of cylindrical member 6.

As can be seen in FIG. 3, tips 23 and 24 of the respective jaws 10 and 11 are desirably separated by a distance less than twice the radius of member 6 so that the wrench cannot be removed without movement of the wrench in the direction of the cylindrical axis of member 6 to either the end of member 6 or to a position of reduced diameter (not shown). In this manner, the wrench as described, lends itself to a rapid ratcheting motion in which member 6 is engaged and turned in one direction; then the wrench is disengaged from the teeth of the cylindrical member and moved in an opposite direction to a new position for a new bite; and then reengaged with the teeth for the next fractional turn. One of the unique features of the present wrench is that the wrench is bi-directional and works equally as well in either direction without the necessity of removing the wrench and turning the wrench either end for end or side for side in order to turn member 6 in the opposite direction.

FIGS. 4 and 5 illustrate a second embodiment of the wrench of the present invention in which jaws 10 and 11 are terminated shortly beyond support means 19 and 20. In this case the wrench is not self-captivating so that it may easily be removed from member 6 by simple withdrawal of the wrench along a radius of member 6. Additionally, each of the jaws 10 and 11 includes a slightly recessed area 28 intermediate the support means 19 and 20 and the closest teeth 15 and 16 respectively of wrench 2. Optimum performance of the wrench may be expected when support means 19 and 20 are at their greatest distances from the opposite outermost teeth 16 and 15 respectively.

Recesses 28—28 assure that no other portion of the wrench jaws 10 and 11 can act as a pivot point or support means similar to the supports provided by 19 and 20. Accordingly, the strength of grip and non-slip characteristics of the wrench are maintained even under working conditions which cause debris to inadvertently bridge between one of the teeth 7 and the respective jaw 10 or 11 so as to inadvertently function as the pivot point intended to be maintained at either point 19 or 20. Such a bridge might lessen the effectiveness of the wrench sufficiently to cause disengagement or slippage which would tend to cause the wrench to lose control and/or smear the tips of teeth 7 or 14.

Turning now to FIGS. 6 and 7, the wrench in combination with the load binder shown in FIG. 1 can be seen. In FIG. 1 the wrench 2 may be axially moved along the length of the load binder and off of the end of the toothed portion 6 to a position adjacent to screw 5: at which position the wrench 2 may be radially removed from the load binder. In this embodiment such removal is enabled by the form of the opening 12 in the wrench head 9 as it is generally U-shaped with an open end. In some circumstances it is desirable that wrench 2 not be removeable. Accordingly, as shown in FIGS. 6 and 7, a shoulder 33 may be provided at one end of toothed portion 6 to prevent axial movement of the wrench in this direction and a groove 34 may be provided at the other end of the toothed portion 6 for receiving a snap ring 35 to prevent movement of wrench 2 axially of the load binder body 3 in the opposite direction. By these means, wrench 2 and load binder 1 are rendered inseperable until snap ring 35 is removed to permit movement of wrench 2 to a position along the load binder which has a diametric dimension smaller than the distance separating the end portions of jaws 10 and 11 so that radial separation becomes possible.

In other applications, prevention of radial separation of the wrench from the member to be turned is desirable. The embodiment of FIG. 8 is therefore intended to satisfy this requirement. In FIG. 8 the member 43 to be turned includes a plurality of circumferentially disposed recesses 36. Recesses 36 are separated by intervening member material which may generally be referred to as teeth or lobes 45. Member 43 may generally be described as a member whose radially outermost surface falls within a cylindrical envelope (44 shown in FIG. 9). In this embodiment the wrench 2 includes an engaging means 38 shown as a single engaging tooth 39 which tapers inwardly toward the member receiving opening 12. The abutting surfaces of tooth 39 and recesses 36 are configured to mate with one another so that a close match is achieved. Additionally, wrench 2 includes a closing bridge portion 37 which causes the head of the wrench to completely encircle member 43 thereby rendering impossible complete radial separation of the wrench head from the member. It should be noted that the member receiving opening 12 thus formed is elongated or oblong in shape: an expedient which permits engaging means 38 to be completely disengaged from the recesses 36 of member 43 through a movement of wrench 2 along a purely radial direction relative to member 43. Once radial disengagement has been accomplished, the wrench may be rotated free of engagement with member 43 to a new angular position for reengagement therewith. In this manner, the wrench may be repositioned to produce a step by step rotation of the member in either direction. Furthermore, the close match between the profile of the engaging means 38 and recesses 36 eliminates play therebetween so as to permit rotation reversal by reversal of the rotational movement of the wrench without relative rotational movement between the member itself and the wrench.

Turning now to FIG. 9, a different embodiment is shown in which the handle assumes a different orientation relative to the engaging means 38. Fulcrum means 19 and 20 are positioned such that head 9 encircles member 43 by more than 180°. In this embodiment fulcrum means 19 and 20 are spaced from one another by a distance which is smaller than the largest diametric dimension of member 43. This being the case, in the arrangement shown member 43 is captivated so that head 9 of wrench 2 cannot be removed from member 43 by movement along one of its radii. In fact, as previously noted, dotted line 44 illustrates the cylindrical envelope within which member 43 fits after wrench 2 and member 43 have been disengaged one from another. In this relative position, wrench 2 is permitted to rotate around the outside of envelope 44 to a new angular position for reengagement and a step by step ratchet type turning action. It will be apparent to those skilled in the art that dotted line 44 as shown in FIG. 9 defines an area within which fulcrum means 19 and 20 must not penetrate if sufficient clearance is to exist so as to enable disengagement for engaging tooth 39 from the particular engaged recess 36 and subsequent rotation of the wrench to a new position of engagement.

FIG. 10 illustrates a further embodiment of the wrench of the present invention in which jaws 10 and 11 and consequently fulcrum means 19 and 20 extend from engaging means 38 by an angle less than 90°. In this arrangement, member 43 is not captivated within the head of the wrench. Additionally, member 43 is shown as having a limited number of recesses 36 to illustrate that a large number of such recesses is not absolutely required in this or any of the other embodiments having a single tooth. Finally, it can be seen that handle 8 is oriented relative to the engaging means 38 at an angle intermediate 0° and 90°. This orientation may also be desirable in a particular application. At this point, it should be clear that many different angular orientations of the handle relative to the elements of the wrench head 9 are operative with some orientations being preferred over the others depending on the specific application.

FIGS. 11, 12 and 13 illustrate a variety of shapes which the teeth of engaging means 38 may assume. In FIG. 11 a generally rectangular tooth 40 is illustrated having parallel sides. In FIG. 12, tooth 41 of engaging means 38 is illustrated as tapering in the radially outward direction in a manner which produces a tooth 41 of a generally keystone shape. Recess 36 is similarly shaped with the requirement that the necked down opening have a size at least large enough to permit the passage of the largest end of tooth 41. FIG. 13 illustrates a variation in which tooth 42 is formed to be bulbular in profile with matching surfaces comprising recess 36. As will be understood, embodiments such as shown in FIGS. 12 and 13 increase the reliability of engagement between the wrench engaging means 38 and the recesses formed in member 43.

We claim:

1. A bi-directional wrench (2) for turning a member (6) in either direction without end to end or side to side reversal of the wrench (2), said member (6) having a multiplicity of equally spaced, outwardly projecting teeth (7) around its periphery whereby the cross-sectional profile of said member (6) at the location of said teeth (7) has the appearance of a multi-lobed star, said wrench (2) having an integral handle (8) and head (9) which includes a pair of jaws (10,11) configured to form a concave opening (12), characterized in that said opening (12) is bounded in part by a plurality of wrench teeth (14) projecting from a concave circular base line (13) having a radius of curvature (C) substantially equal to but not less than the radius (R) drawn from the central axis of said cylindrical member (6) to the tip of one of its teeth (7), said wrench teeth (14) being equally spaced and inwardly projecting with planar faces for engaging the faces of the teeth (7) of said member (6); the mutually facing faces (17,18) of the two outermost teeth (15,16) of said wrench (2) being disposed to gradually diverge in the direction of said concave opening (12); said wrench head (9) including first and second member support means (19,20) at opposite sides of said wrench teeth (14) on the circular extension of said base line (13); each support means (19,20) being positioned such that a line (31 or 32) drawn therefrom to the inner root point (21 or 22) of the opposite one of said two outermost teeth (15,16) of said wrench (2) form an angle of less than 90° with the facing face (17 or 18) of said opposite one of said two outermost teeth (15 or 16); said inner root point (21 or 22) being defined as the point at which said facing face (17 or 18) of said opposite one of said two outermost teeth (15 or 16) intersects with said cylindrical surface (13).

2. The bi-directional wrench (2) as recited in claim 1 characterized in that said concave circular base line (13) and said plurality of wrench teeth (14) are disposed to point away from said handle (8).

3. The bi-directional wrench (2) as recited in claim 1 characterized in that the boundary of said opening includes recessed portions (28) intermediate each of said support means (19,20) and the nearest one of said plurality of wrench teeth (14) whereby contact between the recessed portions (28) of said opening boundary and said teeth (7) of said member (6) is prevented.

* * * * *